US011944161B2

(12) United States Patent
Aubert

(10) Patent No.: US 11,944,161 B2
(45) Date of Patent: Apr. 2, 2024

(54) PROCESS FOR THERMOREGULATING A FLEXIBLE CELLULAR MATERIAL BY COMPRESSION AND EXPANSION OF THE GAS TRAPPED IN ITS CELLS AND ASSOCIATED DEVICE

(71) Applicant: Bruno Aubert, Banyuls sur mer (FR)

(72) Inventor: Bruno Aubert, Banyuls sur mer (FR)

(73) Assignee: Bruno Aubert, Banyuls sur Mer (FR)

( * ) Notice: Subject to any disclaimer, the term of this patent is extended or adjusted under 35 U.S.C. 154(b) by 151 days.

(21) Appl. No.: 17/048,249

(22) PCT Filed: Sep. 19, 2019

(86) PCT No.: PCT/EP2019/075209
§ 371 (c)(1),
(2) Date: Oct. 16, 2020

(87) PCT Pub. No.: WO2020/064509
PCT Pub. Date: Apr. 2, 2020

(65) Prior Publication Data

US 2021/0161247 A1 Jun. 3, 2021

(30) Foreign Application Priority Data

Sep. 27, 2018 (FR) ..... 1871095

(51) Int. Cl.
*A43B 7/34* (2006.01)
*A43B 5/00* (2022.01)
(Continued)

(52) U.S. Cl.
CPC ..... *A43B 7/34* (2013.01); *A43B 5/00* (2013.01); *A43B 7/005* (2013.01); *A43B 7/02* (2013.01); *A43B 13/04* (2013.01); *A43B 13/12* (2013.01)

(58) Field of Classification Search
CPC ..... A43B 13/20; A43B 21/28; A43B 13/12
(Continued)

(56) References Cited

U.S. PATENT DOCUMENTS 4,547,978 A * 10/1985 Radford ..... A43B 7/081 36/29
6,089,313 A * 7/2000 Levy ..... F28D 9/0093 165/145
(Continued)

FOREIGN PATENT DOCUMENTS

CN 107788617 3/2018
EP 0646335 A1 4/1995
(Continued)

*Primary Examiner* — Timothy K Trieu
(74) *Attorney, Agent, or Firm* — Maschoff Brennan

(57) ABSTRACT

A flexible cellular material is thermoregulated by compressing and expanding gas trapped in its cells A flexible elastomer material of a device that provide thermoregulation includes two layers of different shore hardness and conductivity and is has gas-filled cells. Each cell has a zone to store the gas when compressing the material in the layer C with higher hardness and thermal conductivity and another zone to expand the gas when decompressing the material in the layer D with lower hardness and thermal conductivity. The flexible material can be used as a sole in shoes to maintain a cool temperature. With each step, the cell zones located in the layer C act as adiabatic chambers whose gasses heat with compression. When the foot leaves the ground the zones of cells located in the layer D then act as a reactor nozzle that will expand the air and therefore cool it.

7 Claims, 1 Drawing Sheet

(51) Int. Cl.

| | |
|---|---|
| ***A43B 7/00*** | (2006.01) |
| ***A43B 7/02*** | (2022.01) |
| ***A43B 13/04*** | (2006.01) |
| ***A43B 13/12*** | (2006.01) |

(58) Field of Classification Search
USPC ..... 36/30 R
See application file for complete search history.

(56) References Cited

U.S. PATENT DOCUMENTS

| | | | | |
|---|---|---|---|---|
| 6,205,682 | B1 * | 3/2001 | Park | A43B 13/20 36/71 |
| 7,383,648 | B1 * | 6/2008 | Litchfield | A43B 13/203 36/29 |
| 7,748,141 | B2 * | 7/2010 | Smith | A43B 13/181 36/28 |
| 9,510,646 | B2 * | 12/2016 | Holt | A43B 7/1464 |
| 2004/0221483 | A1 * | 11/2004 | Cartier | A43B 13/181 36/27 |
| 2012/0018418 | A1 | 1/2012 | Shantha et al. | |
| 2012/0210604 | A1 * | 8/2012 | Polegato Moretti | A43B 7/087 36/83 |
| 2014/0196308 | A1 * | 7/2014 | Baratta | A43B 13/206 12/146 B |
| 2017/0035146 | A1 * | 2/2017 | Peyton | A43B 13/20 |
| 2018/0220739 | A1 | 8/2018 | Baychar | |

FOREIGN PATENT DOCUMENTS

| | | | |
|---|---|---|---|
| FR | 1501793 | A | 11/1967 |
| FR | 2958505 | A1 | 10/2011 |
| KR | 20160066190 | | 6/2016 |
| WO | 2005087031 | | 9/2005 |

* cited by examiner

Sole without strength

Compressed sole
by foot

Decompressed sole

PROCESS FOR THERMOREGULATING A FLEXIBLE CELLULAR MATERIAL BY COMPRESSION AND EXPANSION OF THE GAS TRAPPED IN ITS CELLS AND ASSOCIATED DEVICE

BACKGROUND

The present invention relates to a process of thermoregulating a flexible cellular material through the compression and expansion of the gas trapped in its cells and its associated device.

The preferred application is for the soles of shoes, allowing the foot to maintain a cool temperature even while walking on a hot road.

Prior art: There are few devices for refreshing shoe soles. There are many gel-filled sole devices that are placed in a freezer to store coldness, but this type of device is impractical because the cold temperature is too intense at the beginning which risks the creation of burns, and then the device quickly becomes less effective. Secondly, the duration of the cooling effect is very short (a few minutes to tens of minutes) and, for example, is not suitable for long jogging sessions.

There are many devices that claim the use of Peltier effect components as in KR20160066190, US2012018418 or WO2005087031. However, these devices require a significant power supply because the yields of Peltier effect components are not very good. Thus, the generation of enough refrigeration will not be possible for periods of one hour or more. In addition, these Peltier effect components are generally made of ceramic and are therefore very fragile. Finally, between the weight of components and that of the batteries, it quickly becomes too heavy in sports shoes that generally must be light.

There are also devices that use breathable materials to evacuate water as described in US2018220739 or porous materials for better ventilation as in CN107788617, but none of these systems allows for true thermal regulation or for a significant drop or rise in temperature.

DETAILED DESCRIPTION

Description of the invention: The novel process concerns the thermoregulation of a flexible cellular material by compression and then expansion of the gas trapped in its sealed cells when cyclic pressure is exerted on the flexible material, for example, when a person or an animal walks (the foot resting on the ground then lifting off of the ground, etc.).

The flexible material is preferably made of silicone or other elastomer and consists of two layers of different shore hardness (H) and thermal conductivity (λ) and are equipped with a multitude of specific cells filled with air or with gas. Each cell has two interconnected zones: zone C to store the air or gas during compression and which is positioned in the layer with higher hardness and thermal conductivity (layer C) and zone D to expand the same air or gas during decompression in the layer with lower hardness and thermal conductivity (layer D).

Thus, the flexible material can be used as a sole in shoes to maintain a cool temperature when the person runs, for example, on a hot surface. With each step, the foot will compress the flexible material and the cells in the layer C will act as adiabatic chambers whose gas will heat up via compression. Since layer C has a greater thermal conductivity than the layer D, there will be a better heat exchange with the outside (in this case the bottom of the shoe).

When the foot leaves the ground and thus there is no more compression, the flexible material will regain its volume through the play of the elasticity of the material, and the cells located in the layer (D) will act like a reactor nozzle that will expand the air and therefore cool it. Since layer D has a lower thermal conductivity, the exchanges will be weaker, and the cold will be better preserved.

According to another preferred arrangement, the material is adapted to the morphology of domestic animals such as cats and dogs which often burn their paw pads when traveling on a road in direct sunlight. This is particulary the case for rescue dogs.

According to another provision, the flexible cellular material can be used as a carpet in public buildings or businesses with a lot of foot traffic so that the numerous foot pressures provide thermoregulation.

Figure 1:
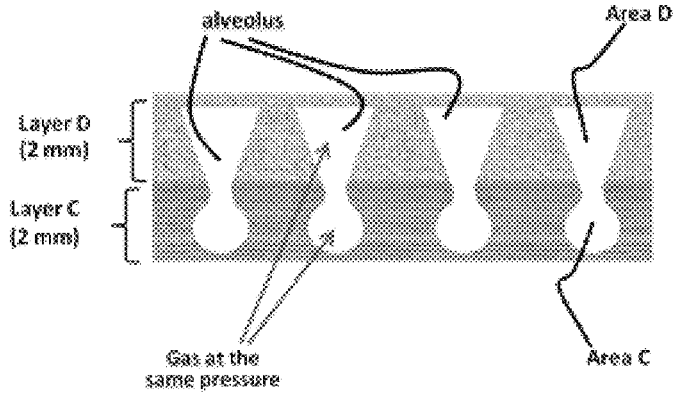
FIGS. 1-3 are cross-sectional views of a device for thermoregulation by compression and expansion of a gas.
Figure 2:
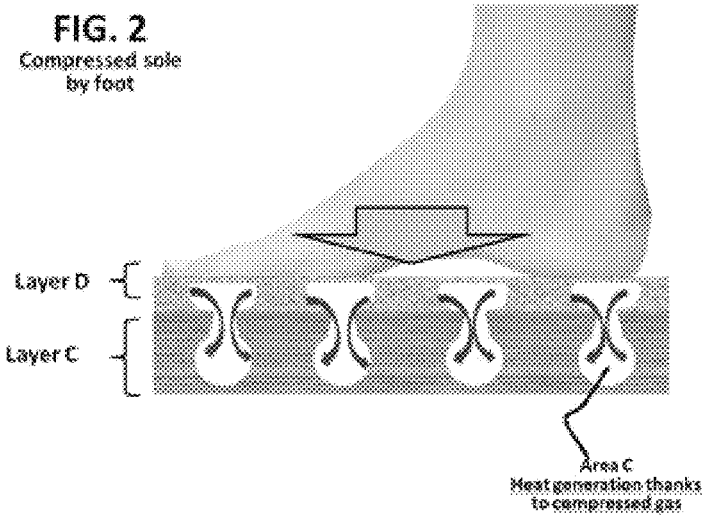
Figure 3:
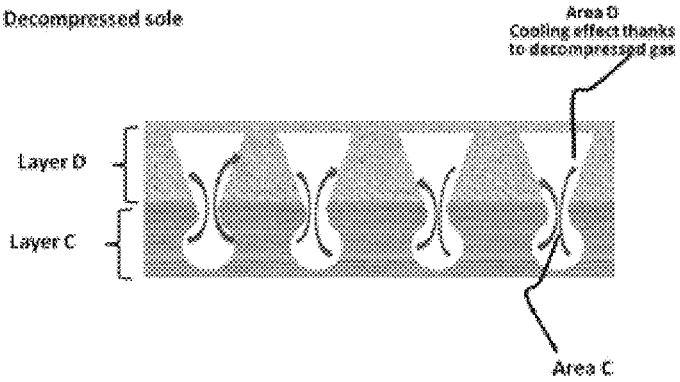

FIGS. 1 to 3 show the device intended in sections, for example, to be placed as a sole in shoes with the layer D in contact with the foot.

in FIG. 1, the cellular flexible material is at rest and the gas is uniformly distributed in the cells at the temperature $T_a$ and pressure $P_a$. A distinction is made between the two layers C and D and the respective zones C and D of the cells.

in FIG. 2, pressure is applied to the flexible material and since layer D has a lower hardness than layer C, layer C will be less compressed. However, gas located in the D zones of the cells will be pushed into the C zones of the cells. Then, the gas will be compressed at the pressure $P_i$ (depending on the pressure exerted, i.e., about 2 bars for a person weighing 70 kg) and will therefore heat up to the temperature $T_i$ according to the laws of thermodynamics.

The temperature $T_i$ of the gas will thus be equal to:

$$T_a \times (P_i/P_a)^{(\gamma-1)/\gamma}$$

where γ is the adiabatic constant of the gas (approximately 1.4 for air at 293° K.) and about 376° K. if $T_a$ is 293° K. Since layer C has a greater thermal conductivity, the heat of the gas will then dissipate more easily through this layer to reach the temperature $T_f$ of about 365° K. for a thermal conductivity λ of the layer C de 1 W/m/° K.

FIG. 3 shows the material once the pressure is released (when the foot leaves the ground). The gas, pressurized, at the temperature $T_f$, will leave the zones C to expand in the zones D and thus cool down to the temperature:

$$T = T_f \times (P_d/P_i)^{(\gamma-1)/\gamma}$$

or about 285° K., a temperature 8° K. lower than the initial temperature $T_a$. Thanks to the low heat exchange operated by the D layer, this temperature difference will be maintained thanks to the repeated steps cycles and despite the losses inherent to the materials and to the absorption of the runner's foot.

In another arrangement, the flexible material may be used as a heating method. It suffices for this to invert the sole and therefore it is the layer C which is in contact with the foot. Thus, the heat generated during the compression will be in contact with the foot while the cold zone will be in contact with the bottom of the shoe.

The gas contained in the cells may simply be air, but it is advantageous to use gases with a higher adiabatic constant γ such as a monoatomic gas (Ar for example) in order to obtain a higher yield.

The invention claimed is:

1. A device for thermoregulation comprising:

a flexible and elastic material that is inside the shoe as a sole, having sealed cells filled with air or with gas, each cell having two interconnected zones, including:

a first zone storing the gas during the compression of said flexible material, a second zone that is configured as a nozzle to expand the same gas during the decompression of said flexible material, wherein:

the first zone is disposed vertically relative to the second zone; and said material is formed in two layers, including:

a first layer with a first shore hardness in which are arranged the first zones of the cells for storing gas during the compression of the material, and a second layer with a second shore hardness in which are arranged the second zones of the cells for expanding the same gas during the decompression of the material, wherein: the first shore hardness corresponding to the first layer is higher than the second shore hardness corresponding to the second layer; and the second layer is positioned on a foot side of the sole and the first layer is positioned on a bottom side of the sole configured to keep a foot of a user of the sole cool despite a warm ground.

2. The device according to claim 1, wherein the flexible and elastic material is inside a shoe as a sole, the second layer being positioned on a foot side of the sole and the first layer being positioned on a bottom side of the sole configured to keep a foot of a user of the sole cool despite a warm ground.

3. The device according to claim 1, wherein the flexible and elastic material is inside a shoe as a sole, the first layer being positioned on a foot side of the sole and the second layer being positioned on a bottom side of the sole configured to keep a foot of a user of the sole warm despite a cold ground.

4. The device according to claim 1, wherein the flexible and elastic material is used inside a shoe as a sole, the first layer being positioned on a foot side of the sole and the second layer being positioned on a bottom side of the sole configured to keep a foot of a user of the sole warm despite a cold ground.

5. A device for thermoregulation comprising: a flexible and elastic material that is inside the shoe as a sole, having sealed cells filled with air or with gas, each cell having two interconnected zones, including: a first zone storing the gas during the compression of said flexible material, a second zone that is configured as a nozzle to expand for the same gas during the decompression of said flexible material, wherein: the first zone is disposed vertically relative to the second zone; and said material is formed in two layers, including: a first layer with a higher thermal conductivity in which are arranged the first zones of the cells for storing gas during the compression of the material, and a second layer with a lower thermal conductivity in which are arranged the second zones of the cells for expanding the same gas during the decompression of the material; and the second layer is positioned on a foot side of the sole and the first layer is positioned on a bottom side of the sole configured to keep a foot of a user of the sole cool despite a warm ground.

6. The device according to claim 5, wherein the flexible and elastic material is inside a shoe as a sole, the second layer being positioned on a foot side of the sole and the first layer being positioned on a bottom side of the sole configured to keep a foot of a user of the sole cool despite a warm ground.

7. The device according to claim 5, wherein the flexible and elastic material is inside a shoe as a sole, the first layer being positioned on a foot side of the sole and the second layer being positioned on a bottom side of the sole configured to keep a foot of a user of the sole warm despite a cold ground.

* * * * *